US006244453B1

(12) United States Patent
Maschio

(10) Patent No.: US 6,244,453 B1
(45) Date of Patent: Jun. 12, 2001

(54) CISTERN FOR STORING AND CARRYING LIQUIDS

(76) Inventor: Pietro Maschio, Via Lazio, 16, 20056 Grezzago (Milano) (IT)

( * ) Notice: Subject to any disclaimer, the term of this patent is extended or adjusted under 35 U.S.C. 154(b) by 0 days.

(21) Appl. No.: 09/623,538

(22) PCT Filed: Dec. 9, 1998

(86) PCT No.: PCT/IT98/00352

§ 371 Date: Sep. 5, 2000

§ 102(e) Date: Sep. 5, 2000

(87) PCT Pub. No.: WO99/44912

PCT Pub. Date: Sep. 10, 1999

(30) Foreign Application Priority Data

Mar. 5, 1998 (IT) ..... MI98U0139

(51) Int. Cl.[7] ..... B65D 88/62
(52) U.S. Cl. ..... 220/9.1; 220/9.4; 220/639
(58) Field of Search ..... 220/9.1, 9.4; 206/386, 206/646, 639

(56) References Cited

U.S. PATENT DOCUMENTS 2,019,044 * 10/1935 Brown ..... 220/9.1
4,909,387 * 3/1990 Schutz .
5,024,346 * 6/1991 Rosger ..... 220/9.1
5,058,747 * 10/1991 Decroix et al. ..... 220/9.1
5,437,384 * 8/1995 Farrell ..... 220/9.4
5,653,354 * 8/1997 Olson ..... 220/9.1
5,746,343 * 5/1998 Waltke et al. ..... 220/9.4
6,095,361 * 8/2000 Huang ..... 220/9.1

FOREIGN PATENT DOCUMENTS 297 19 830 U * 5/1998 (DE) .
0755863 * 1/1997 (EP) .

* cited by examiner

*Primary Examiner*—Joseph M. Moy
(74) *Attorney, Agent, or Firm*—Hedman & Costigan, P.C.

(57) ABSTRACT

An improved cistern (1) for storing and carrying liquids comprises supporting means, a tank and holding means for holding said tank, said holding means being operatively connected both to said supporting means (6), a tank (7), in which said holding means comprise a metal cage (5) made of metal hollow pipes having a quadrilateral cross section, the horizontally arranged pipes (2) having an asymmetric contour, whereas the vertically arranged pipes (3) have a symmetrical contour.

8 Claims, 3 Drawing Sheets

CISTERN FOR STORING AND CARRYING LIQUIDS

BACKGROUND OF THE INVENTION

The present invention relates to an improved cistern specifically designed for holding and carrying liquids.

As known, liquid holding and carrying cisterns must meet a plurality of rather strict requirements, in order to be certified as suitable for public use.

The above requirements, in particular, are very stringent for those cisterns specifically designed for carrying liquids in general, such as food and industrial liquids, because of a great variation of the specific gravity thereof, affecting the stress the holding and carrying cistern is subjected to.

These stress values, in fact, vary from 0.8–0.9 to less than 2 $Kg/m^3$, and, since the cisterns of the above mentioned type have a volume of several cubic meters, weight variations of the order of tons will occur.

Prior cisterns for the intended applications conventionally comprise a bottom pallet, thereon is fastened a metal outer cage, encompassing a holding tank usually made of a plastic material and fastened to the top of the cage, for example by two or more metal cross-members.

While the above mentioned prior cisterns solve the indicated technical problem, they, however, are affected by the following disadvantages.

The metal pipes forming said outer cage have contours which are not suitable for mating the operating conditions of automatized lines. In particular, great problems are encountered for automatizing the welding operations provided for firmly fastening the cage forming pipes at crossing points thereof.

Actually, in the prior art, the mentioned cage forming pipes are welded by manually controlled welding apparatus, thereby greatly increasing the welding time and cost, because of a substantial requirement of manual labour.

Moreover, the quality controls too are performed by manually controlled implements, thereby they will require a lot of labour, and, moreover, being scarcely reliable.

In this connection it should be pointed out that a critical aspect of the above mentioned quality controls is that related to the mentioned welding operations proper, since the welded regions must overcome very rigorous and accurate control tests; thus, in prior cistern making methods, the above mentioned quality controls will require a very long time with a consequent negative effect on the cistern making cost.

The document EP-A-0 755 863 discloses a cistern substantially according to the preamble of claim 1.

SUMMARY OF THE INVENTION

Accordingly, the aim of the present invention is to overcome the above mentioned drawbacks affecting the prior cisterns and making methods therefor.

For achieving the above mentioned aim, the invention provides an improved cistern, specifically designed for holding and carrying liquids, which can be easily made on automatic assembling lines, in which the quality controls can be automatically performed in a very quick and efficient manner, thereby providing a safe, reliable product, of a comparatively small cost, and adapted to meet any enforcing constructional rules.

Briefly, according to the invention, an improved cistern specifically provided for holding and carrying liquids has been provided, said cistern comprising supporting means, a tank and tank holding means, said tank holding means being operatively connected both to said supporting means and to said tank, in which said tank holding means comprise a metal cage formed by a plurality of crossing metal hollow pipes having a quadrilateral cross-section, the horizontally arranged pipes or bars having an asymmetrical contour, while the vertically arranged pipes or posts have a symmetrical contour.

The improved cistern, specifically designed for holding and carrying liquids according to the invention, is characterized by that characterizing features of the enclosed claim 1.

The improved cistern, specifically designed for holding and carrying liquids according to the invention, provides the following advantages.

The cross-section contours or profiles used for the metal pipes forming the aforesaid cage are very suitable for processing on automatized processing lines, in particular for automatic welding lines for performing the welding operations for welding the crossing points or regions of said pipes, which welding operations, according to the invention, can be performed in a very accurate and quick manner.

Accordingly, the quality controls too can be performed in a very quick and accurate manner, in particular those controls related to the welded points or regions: thus, the made product will be very reliable and it will meet all of the strict enforcing constructional rules.

Finally, the making cost will be comparatively small, owing to the great cost reduction deriving from the very reduced labour required for constructing the cistern according to the invention; thus, the inventive cistern will be very competitive from a mere economic standpoint and, moreover, it will have a very high quality.

BRIEF DESCRIPTION OF THE DRAWINGS

Further characteristics, advantages and constructional details of the improved cistern, specifically designed for holding and carrying liquids, according to the invention, will become more apparent from the following detailed disclosure, with reference to the accompanying drawings, where, by way of an indicative, but not limitative example, a preferred embodiment thereof is shown.

In the drawings.

DESCRIPTION OF THE PREFERRED EMBODIMENT

Figure 1:
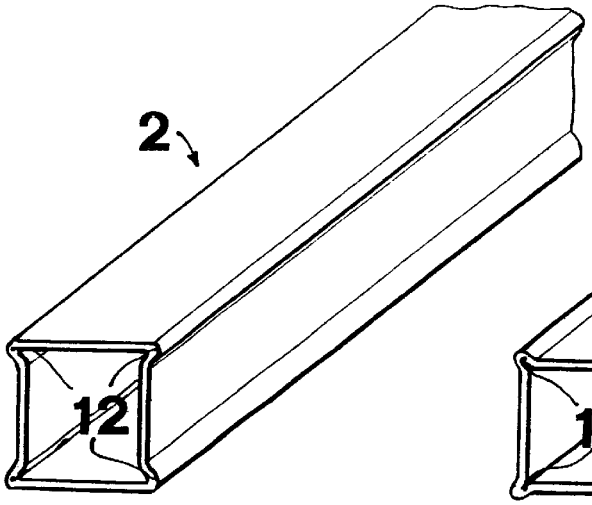
FIG. 1 is a perspective view of a pipe length to be used for forming the horizontal elements of the cage included in the cistern according to the invention.
Figure 2:
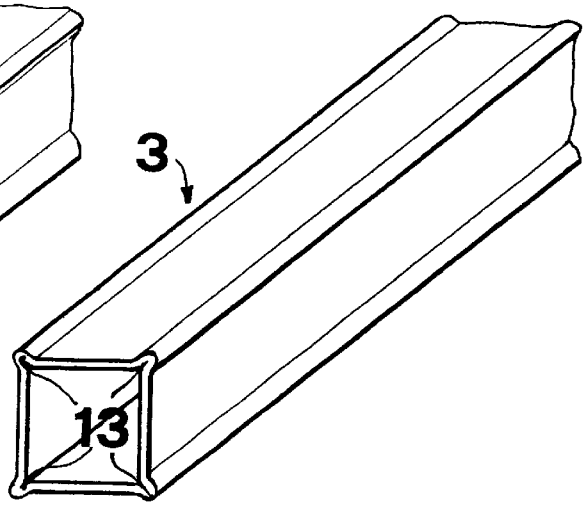
FIG. 2 is a perspective view of a pipe length to be used for forming the vertical elements of the cage included in the cistern according to the invention.

With reference to the number references of the above disclosed figures, the improved cistern 1, specifically designed for holding and carrying liquids according to the present invention, substantially comprises three components, i.e.: a pallet 6 arranged at a lower position and having bearing and supporting functions, a holding tank 7 for holding liquids herein; and a metal cage 5 having a constructional holding and encompassing function for the tank 7, said cage being connected to said pallet (6) and to said tank.

Advantageously, the metal cage 5 is formed by the right-angle crossings 4 of metal hollow pipes 2, 3, preferably made of a steel material.

More specifically, said pipes or bars 2 forming the horizontal members of the cage 5 have a quadrilateral cross-section having, on each vertex thereof, a cusp 12, said cusps being arranged in an asymmetrical manner with respect to one another, i.e. said cusps meeting with two opposite flat phases and with other two slightly concave faces.

The pipes or posts 3, forming the vertical elements of the cage 5 also have a quadrilateral cross-section and are likewise provided with a respective cusp 13 at each vertex thereof, the cusps 13, however, being symmetrically arranged and the posts 3 having, consequently, four faces all of which are slightly concave.

The above mentioned specifically designed contours or profiles would be particularly advantageous for forming said cage 5 on automatized making lines.

Figure 3:
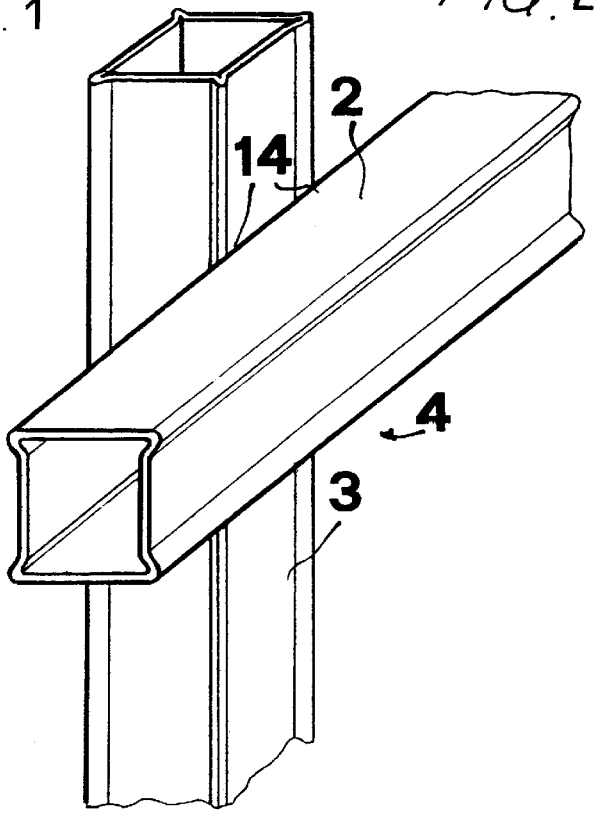
FIG. 3 is a perspective view of a pipe crossing region, i.e. a region where the pipes forming the cage of the cistern according to the invention cross one another.
Figure 4:
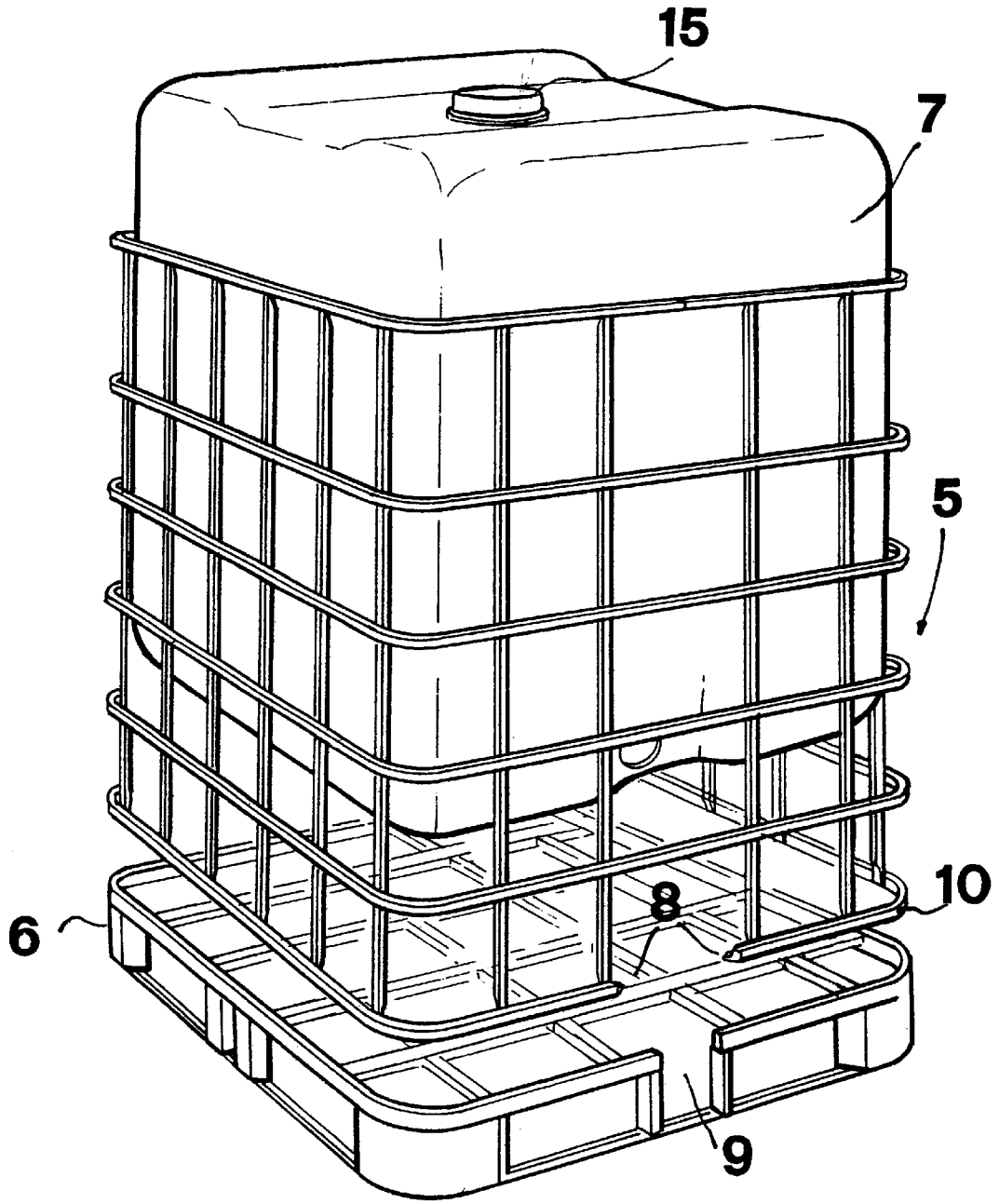
FIG. 4 is an exploded perspective view of the cistern according to the invention.
Figure 5:
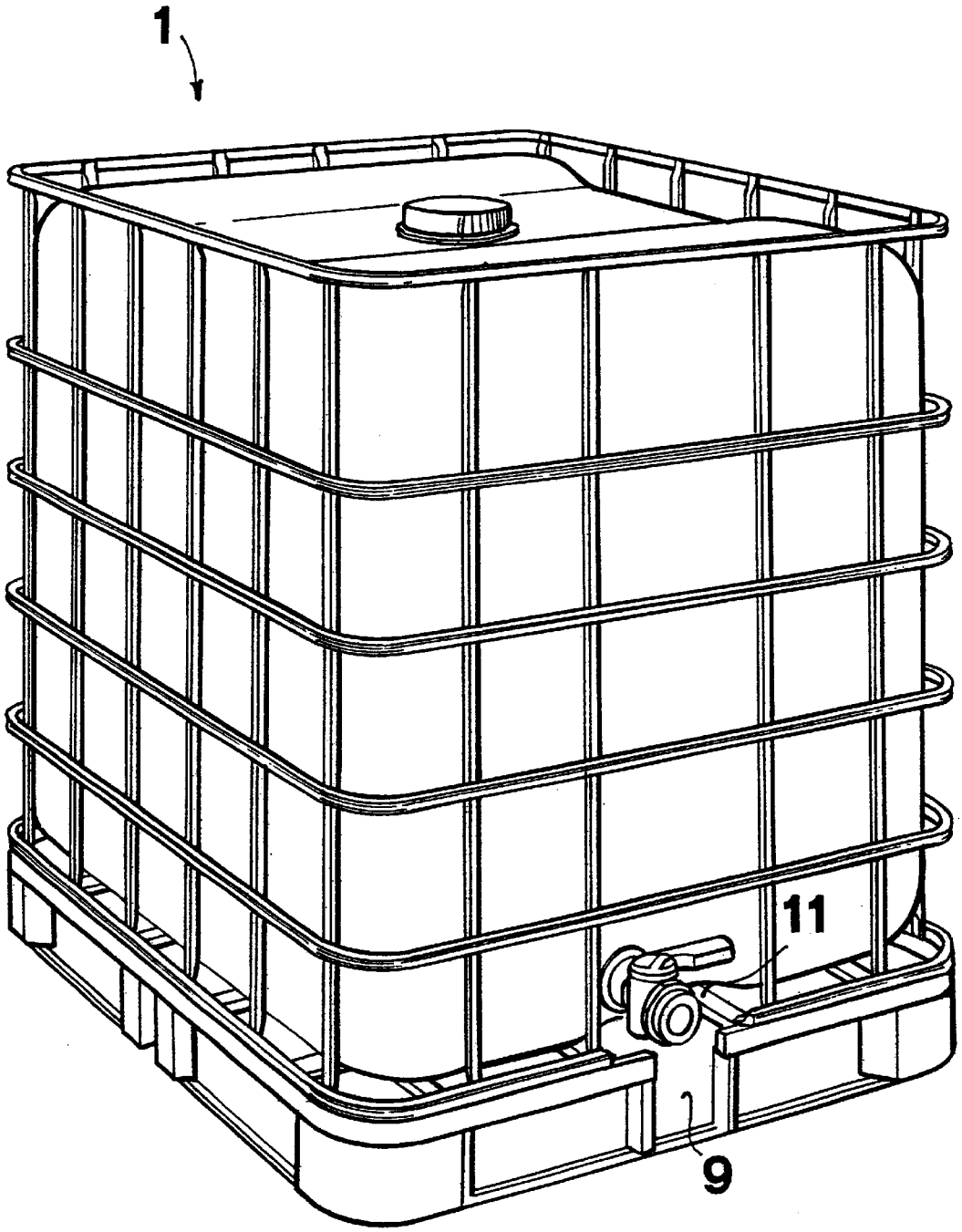
FIG. 5 is a further perspective view of the cistern according to the invention.

In fact, as it is clearly shown in FIG. 3, at each crossing 4 of a bar 2 and a post 3, four contact points are provided, the flat faces of each bar 2 being arranged perpendicularly to the plane defined by the contact region.

This arrangement will be particularly advantageous during the welding operation, in particular a resistance welding operation performed under the control of automatically controlled welding machines, if compared to a contact condition of fully flat or curved faces.

Moreover, the specifically designed of the bars 2 and posts 3, will provide further advantages in the automatic operations for preparing the above mentioned tubes for the welding and bending steps, as well as the loading, orienting, cutting steps, and in a possibly provided plastic deformation step, as required for constructing the cage 5 by welding and bending operations.

Finally, the contours or profiles used for the cross sections of the mentioned pipes 2, 3 will also allow to easily remove those waste elements which could be present on the pipe surfaces.

Moreover, the cage 5 is provided, on its ring-like bottom 10, with a specifically designed gap 8 which, at the end of the pallet 6 and tank 7 assembling operation, will be arranged at a recess 9 formed on the pallet 6 in order to receive an outlet faucet 11 at the bottom of the tank 7.

The pallet 6 can be alternately made of wood, metal alloys or plastic materials, and said pallet has its outer edge provided with a plurality of holes allowing the pallet to be easily connected to the cage 5, the ring bottom 10 of which is provided with a like plurality of corresponding holes.

The tank 7, which is generally made of a plastic material, is provided at the top thereof with a loading inlet 15, and, at the top thereof, with the mentioned outlet faucet 11. In this connection it should be pointed out that the tank will be assembled as a last component during the making of the cistern 1, in particular said tank being threaded from the top on the cage 5 already fastened to the pallet 6 and being then fixed or restrained at the top thereof by at least a pair of metal cross-members, not shown, anchored to said cage 5.

It should be apparent that the shape and size of the elements forming the improved cistern, specifically designed for holding and carrying liquids according to the invention, can be changed depending on requirements, without departing from the inventive scope.

The use and loading-unloading procedure for using the cistern 1 according to the present invention will be self-evident from the preceding disclosure, and they will be fully analogous to those provided for a conventional liquid carrying cistern.

In particular, the cistern will be loaded through the inlet 15, and it will be transported upon loading it by suitable crane apparatus on a train or other road transport means.

After having unloaded the cistern 1 at the use place, it will be possible to discharge, through the faucet 11, the stored liquid.

In all these operating steps, the specifically designed grid-like construction of the cage 5 will assure a firm support for the cistern 1, and will meet all of the safety rules related to any safety operator conditions.

What is claimed is:

1. A cistern, specifically designed for holding and carrying liquids, comprising supporting means, a tank (7) and holding means for holding said tank, said tank holding means being operatively coupled both to said supporting means and to said tank (7), said tank holding means comprising a metal cage (5), made of a plurality of crossings (4) of metal hollow horizontally and vertically arranged pipes (2, 3) having a quadrilateral cross-section, the horizontally arranged pipes (2) having an asymmetrical contour, whereas the vertically arranged pipes (3) have a symmetrical contour, characterized in that said horizontally arranged pipes (2) have a cusp (12) at each vertex of their cross-section, said horizontally arranged pipes (2) having two external flat faces opposite to one another, the remaining faces being slightly concave and having a cross-section being asymmetrical in a diagonal plane between two opposing corners, said vertically arranged pipes (3) having a cusp (13) at each vertex of their cross-section, said pipes (3) having four external concave faces and a cross-section being symmetrical in a diagonal plane between two opposing corners and that at each crossing of a horizontal (2) and vertical (3) pipes, the horizontal pipe (2) is arranged such that the flat faces of the horizontal pipe (2) are arranged perpendicularly to the plane defined by the contact region, so that at each crossing, four contact points are provided.

2. A cistern according to claim 1, characterized in that said metal cage (5) is provided with a ring-like bottom (10) having a gap (11) and a plurality of holes for the connection with said supporting means.

3. An improved cistern, specifically designed for holding and carrying liquids according to claim 1, characterized in that said crossings (4) are arranged at right angles with respect to one another, and being each provided with four contact points (14).

4. An improved cistern, specifically designed for holding and carrying liquids according to claim 1 characterized in that said metal cage (5) is provided with a ring-like bottom (10) having a gap (11) and a plurality of holes for the connection with said supporting means.

5. An improved cistern, specifically designed for holding and carrying liquids according to claim 1, characterized in that said supporting means comprise a pallet (6) having a plurality of perimetrical holes for connecting with said metal cage (5) and being provided, on a side thereof, with a recess (9) which, upon coupling, will be arranged at said gap (11).

6. An improved cistern, specifically designed for holding and carrying liquids according to claim 1, characterized in that said tank (7) is provided with an inlet (15) and an outlet faucet (11), and being connected to said cistern (1) by a plurality of cross members operatively connected to said cage (5).

7. An improved cistern, specifically designed for holding and carrying liquids according to claim 1, characterized in that said pipes (2, 3) forming said cage (5) are made of steel.

8. An improved cistern, specifically designed for holding and carrying liquids according to claim 1, characterized in that said pallet (6) can be made of wood, a metal alloy or a plastic material.

* * * * *